United States Patent [19]

Spanier

[11] Patent Number: 4,829,601

[45] Date of Patent: May 16, 1989

[54] BIB FAMILY/COMBINATION TODDLER BIB AND DOLL

[76] Inventor: Marilyn Spanier, 301 E. 76 St., (#4), New York, N.Y. 10021

[21] Appl. No.: 180,006

[22] Filed: Apr. 11, 1988

[51] Int. Cl.[4] ..... A41B 13/10

[52] U.S. Cl. ..... 2/49 R; 446/26

[58] Field of Search ..... 2/48, 49 R, 49 A, 50, 2/51; 40/586; 446/369-372, 901

[56] References Cited

U.S. PATENT DOCUMENTS

| | | | |
|---|---|---|---|
| D. 62,270 | 5/1923 | Benson | 2/48 X |
| D. 72,665 | 5/1927 | Bowman | 2/48 X |
| D. 290,421 | 6/1987 | McNally et al. . | |
| 3,016,544 | 1/1962 | Pinkney | 2/49 R |
| 3,308,479 | 3/1967 | Sesco, Jr. | 2/50 |
| 3,789,547 | 2/1974 | Chemarin | 446/369 |
| 3,811,220 | 5/1974 | Glass et al. | 446/371 X |
| 3,857,116 | 12/1974 | Meeker . | |
| 4,062,144 | 12/1977 | Holden et al. | 446/371 |
| 4,197,670 | 4/1980 | Cox | 446/369 |
| 4,249,337 | 2/1981 | Edson | 446/372 |
| 4,540,378 | 9/1985 | Cusimano | 446/369 |
| 4,543,669 | 10/1985 | Katz | 446/369 X |
| 4,660,225 | 4/1987 | Kahn . | |
| 4,663,779 | 5/1987 | Bible . | |
| 4,762,494 | 8/1988 | Woods | 446/372 X |

FOREIGN PATENT DOCUMENTS

| | | | |
|---|---|---|---|
| 423200 | 1/1935 | United Kingdom | 446/901 |
| 2013508 | 8/1979 | United Kingdom | 446/901 |

*Primary Examiner*—Werner H. Schroeder
*Assistant Examiner*—Jeanette E. Chapman

[57] ABSTRACT

A toddler bib and doll combination which is comprised of reusable, non-toxic and washable towel material, Rick Rack trim and Bias tape. The body of the bib has at it's upper edges, two armlike extensions of towel material configured to define a neckline for the toddler and said armlike extensions each having at their ends a means for removably attaching armlike extensions such as VELCRO, snap fasteners or other means. The body of the bib, has a three dimensional doll's face of towel material, sewn, by any means, onto said bib body, as well as a doll's three dimensional arms and legs which depend from the appropriate areas of the bib's body for said arms and legs. Additionally, the doll's hair, represented by Rick Rack trim, is sewn, by any means, onto the body of the bib in the appropriate area for said hair, as well as a Bias tape which is contoured around the edges of the body of the bib, and sewn, by any means.

7 Claims, 5 Drawing Sheets

FIG. 6
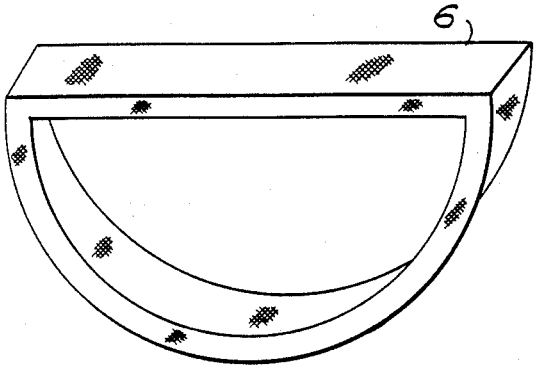
FIG. 10
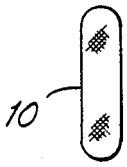
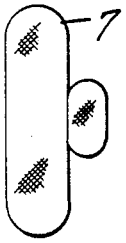
FIG. 7
FIG. 11
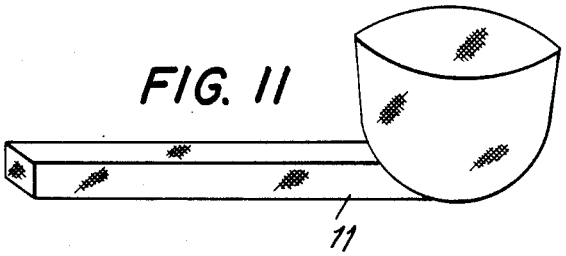
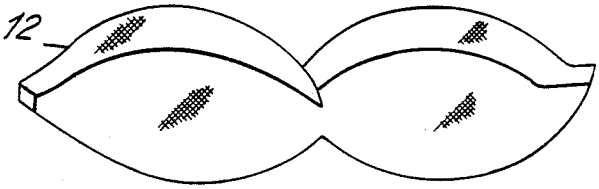
FIG. 12
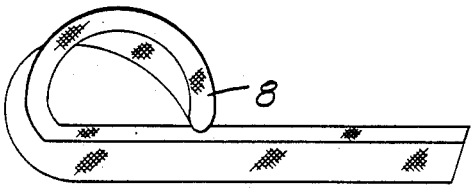
FIG. 8
FIG. 13
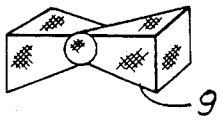
FIG. 9
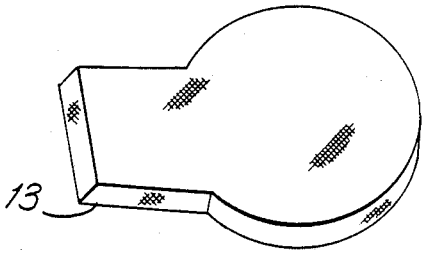

BIB FAMILY/COMBINATION TODDLER BIB AND DOLL

BACKGROUND OF THE INVENTION

1. Field of the Invention

This invention relates generally to protective coverings for clothing such as bibs for toddlers and more particularly to a combination toddler bib and doll.

2. Description of Prior Art

No bibs up until now have had a doll with a three dimentional face and depending arms and legs incorporated as part of the toddler bib, thereby not only protecting the toddler's clothing while feeding, but also keeping the toddler playfully occupied during feeding, thereby facilitating feeding for today's busy parents or guardians as well as entertaining the toddler.

SUMMARY OF THE INVENTION

This invention is an improved reusable and non-toxic toddler bib which comprises a toddler bib and a doll. This invention not only protects the toddler's clothing during feeding, but this improved toddler bib also entertains the toddler and keeps the toddler playfully occupied during feeding, thereby making feeding a more pleasant and stimulating experience for the toddler and therefore, more convenient for today's busy parents or guardians than existing bibs.

An object of the invention is to provide a reusable and non-toxic toddler bib.

Another object of the invention is to provide a lightweight article that can be conveniently carried around which can be used as either a bib, a doll or both.

BRIEF DESCRIPTION OF THE DRAWINGS

FIG. 6 is the top, side and frontal view of the combination toddler bib and doll's mouth;

FIG. 7 is the side view of the combination toddler bib and doll's eye;

FIG. 8 is the bottom, side and frontal view of the combination toddler bib and dog doll's tail;

FIG. 9 is the top, side and frontal view of the combination toddler bib and doll's bowtie;

FIG. 10 is the side view of the combination toddler bib and doll's cheek;

FIG. 11 is the top and side view of the combination toddler bib and man doll's pipe;

FIG. 12 is the top, side and frontal view of the combination toddler bib and man doll's moustache;

FIG. 13 is the top and side view of the combination toddler bib and dog doll's tongue;

DESCRIPTION OF THE PREFERRED EMBODIMENTS

Figure 1:
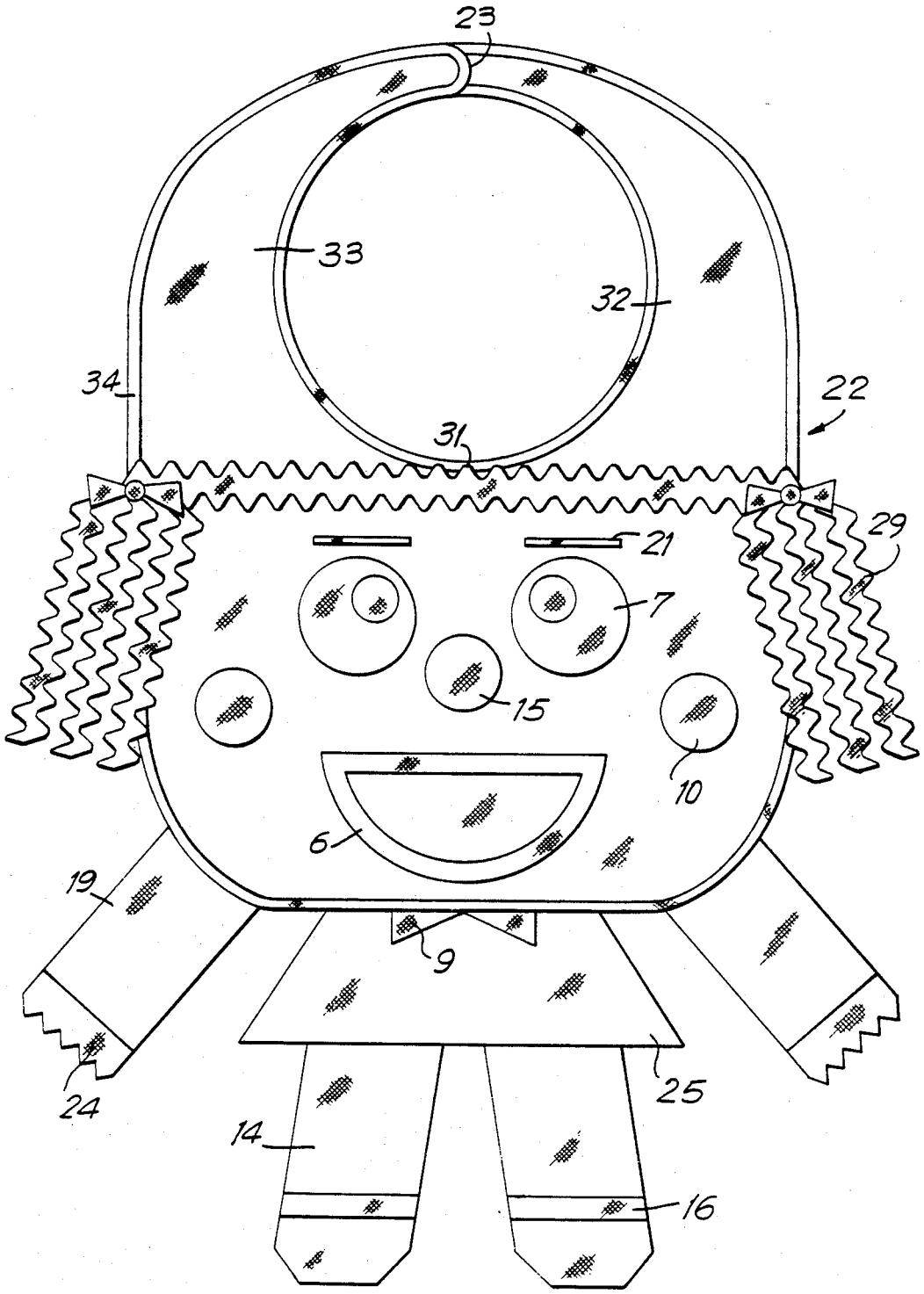
FIG. 1 is a front plan view showing the combination toddler bib and doll in the embodiment of a little girl.

Throughout the following description reference will be made to the drawings. Identical numerals will be used throughout the several views to indicate the same or like parts of the invention. The invention's structure and use will be discussed.

Referring now to FIGS. 1 through 5, the body portion of bib 22 is made of a washable and non-toxic towell material. Since bib 22 is washable, the consumer saves money, being allowed the opportunity to reuse bib 22 for an extended period of time. All materials used in the invention are of towel material with the exception of the doll's hair 29 which is made of Rick Rack trim and the border of the bib body portion 22 which is contoured with Bias tape 34. The Bias tape 34 is represented in FIGS. 1 through 5 by the dots which are contoured around the bib body portion 22. The towel material, as well as the Rick Rack trim 29 and Bias tape 34 are non-toxic and, therefore safe for the toddler, if said toddler puts the bib in his or her mouth. Bib 22 has two armlike extentions 32 and 33 of the same towel material configured to define a neckline. The inside edges of armlike extentions 32 and 33 are contoured 31 to fit smoothly under the chin and around the neck of the toddler. At the ends of the armlike extentions 32 and 33 are any such removably attaching means 23. Any such removably attaching means can be used including VELCRO, snap fasteners or other means. FIGS. 1 through 5 are all made of the same towel material and are all lightweight. FIGS. 1 through 5 are also easily foldable for storage when not in use. Contoured along the outer edges of bib 22 is sewn, by any means, a bias tape 34. This Bias tape 34 provides durability and will keep the edges of bib 22 from separating or tearing. The doll's facial features in FIGS. 1 through 5 are made with towel material and sewn, by any means, onto the body of bib body 22, thereby forming three dimentional facial features. These facial features, mouth 6, eyes 7, cheeks 10, moustache 12, dog's tongue 13, nose 15, dog's mouth 18, little boy's two front teeth 20, and eyebrows 21 are made with contrasting colors to have a pleasant appearance as well as to stimulate the toddler's senses.

FIG. 1 is in the embodiment of a little girl doll. The little girl doll in FIG. 1 has eyes 7, a nose 15, eyebrows 21, cheeks 10, a mouth 6, curly hair in pony tails 29, hands 24, arms 19, legs 14 and she is wearing a short skirt 25, a pair of ankle socks 16 and a bowtie 9.

Figure 2:
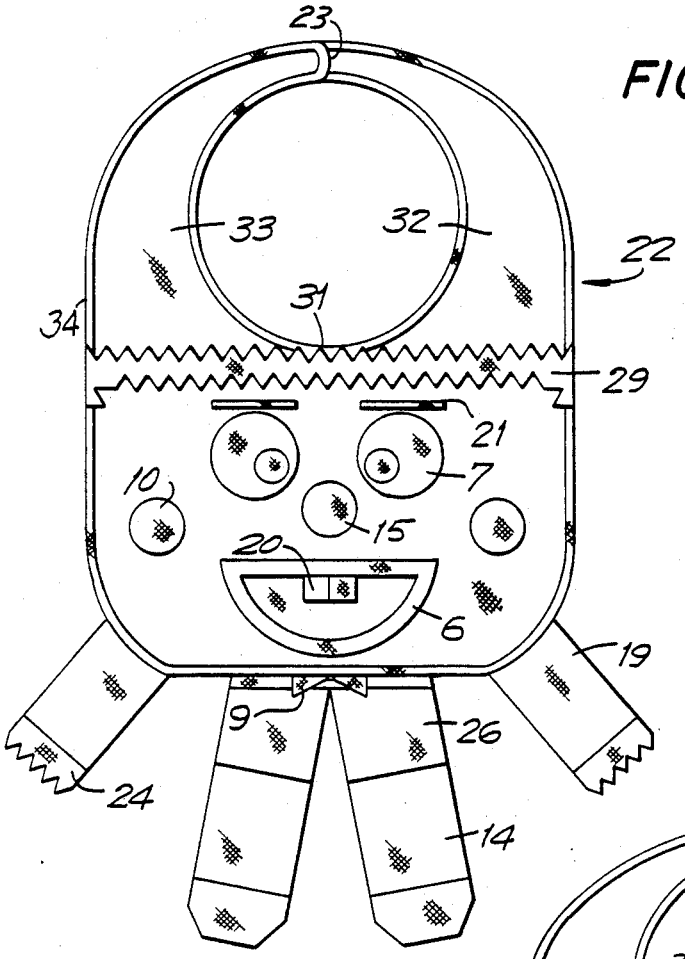
FIG. 2 is a front plan view showing the combination toddler bib and doll in the embodiment of a little boy.

FIG. 2 is in the embodiment of a little boy doll. The little boy doll in FIG. 2 has eyes 7, a nose 15, cheeks 10, a mouth 6, eyebrows 21, two front teeth 20, curly hair 29, legs 14, arms 19, hands 24 and he is wearing shorts 26 and a bowtie 9.

Figure 3:
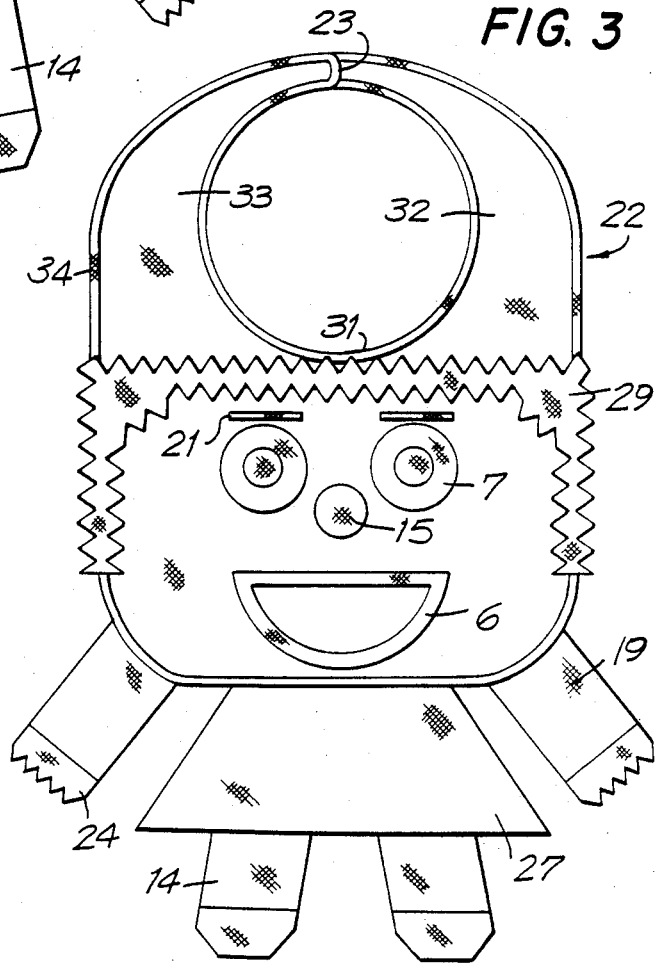
FIG. 3 is a front plan view showing the combination toddler bib and doll in the embodiment of a woman.

FIG. 3 is in the embodiment of a woman doll. The woman doll in FIG. 3 has eyes 7, eyebrows 21, a nose 15, a mouth 6, curly hair 29, arms 19, hands 24, legs 14 and she is wearing a long skirt 27.

Figure 4:
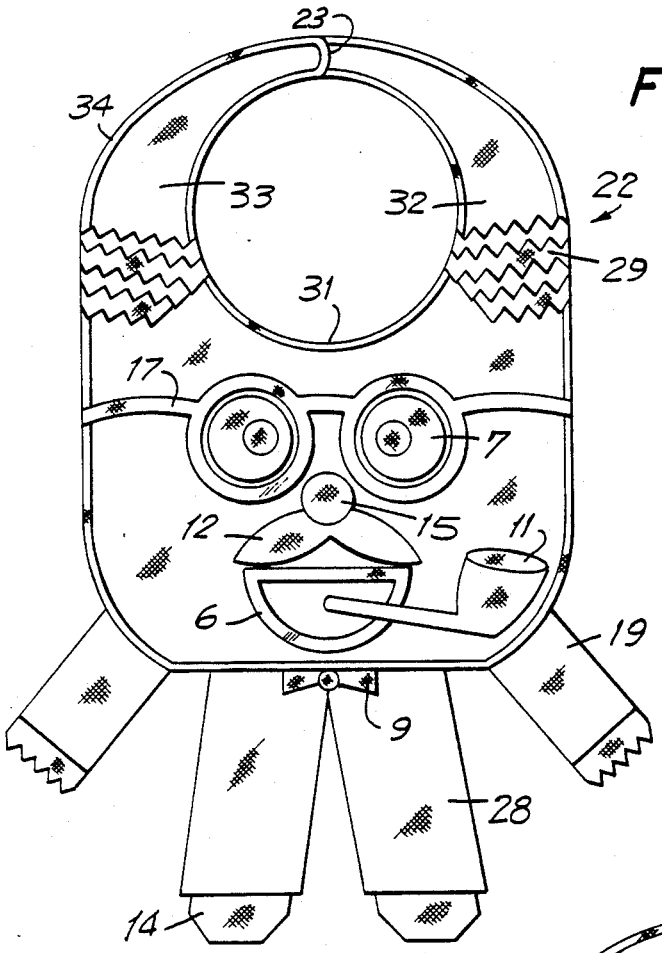
FIG. 4 is a front plan view showing the combination toddler bib and doll in the embodiment of a man.

FIG. 4 is in the embodiment of a man doll. The man doll in FIG. 4 has eyes 7, a nose 15, a mouth 6, curly hair on the sides of his head 29, a moustache 12, arms 19, hands 24, legs 14, and he is wearing trousers 28, a bowtie 9, eyeglasses 17 and a pipe 11.

Figure 5:
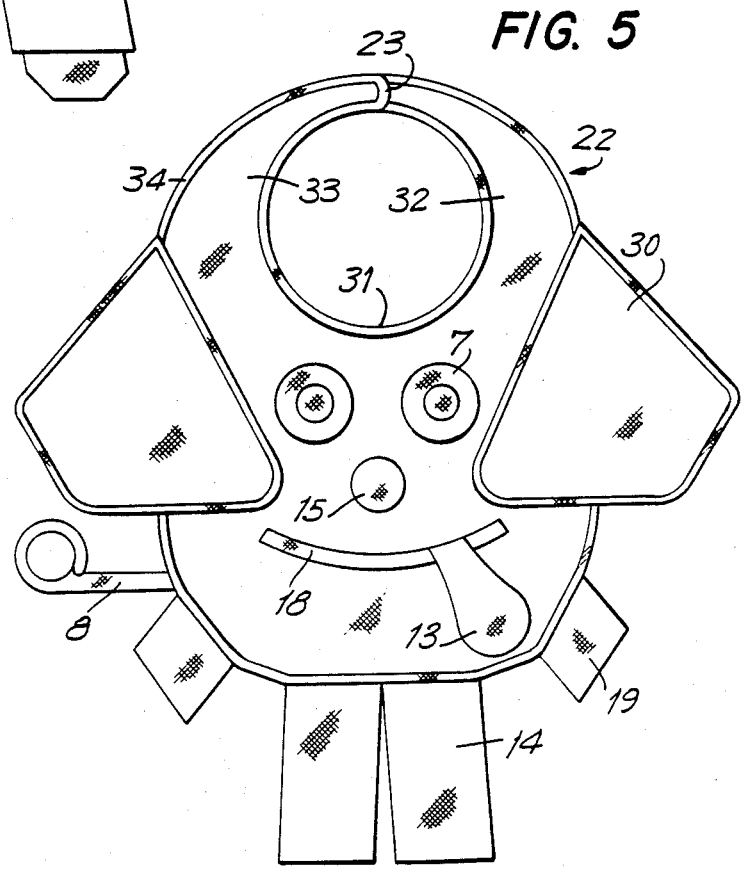
FIG. 5 is a front plan view showing the combination toddler bib and doll in the embodiment of a dog.
Figure 14:
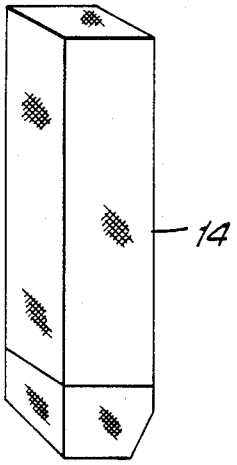
FIG. 14 is the top and side view of the combination toddler bib and doll's legs.
Figure 18:
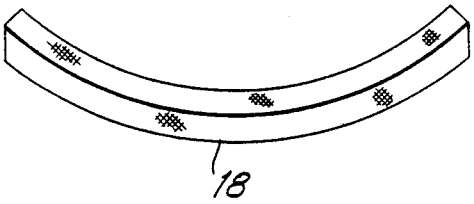
FIG. 18 is the top and frontal view of the combination toddler bib and dog doll's mouth.
Figure 19:
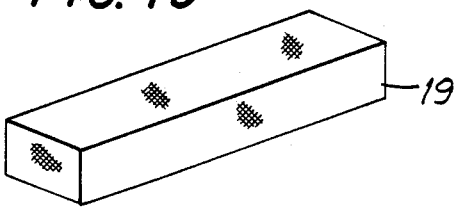
FIG. 19 is the side and frontal view of the combination toddler bib and doll's arms.
Figure 15:
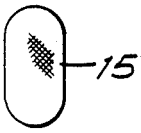
FIG. 15 is the side view of the combination toddler bib and doll's nose.
Figure 16:
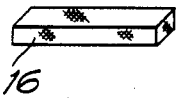
FIG. 16 is the top, side and frontal view of the combination toddler bib and little girl doll's ankle socks.
Figure 20:
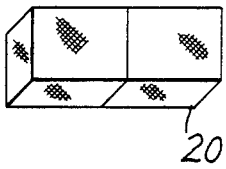
FIG. 20 is the side, bottom and frontal view of the combination toddler bib and little boy doll's two front teeth.
Figure 17:
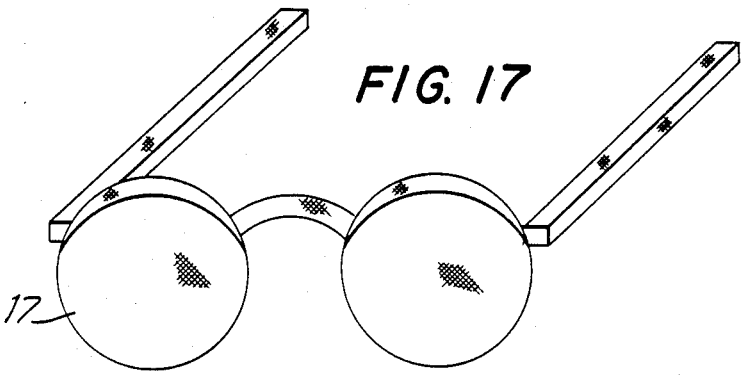
FIG. 17 is the top, side and frontal view of the combination toddler bib and man doll's eyeglasses.
Figure 21:
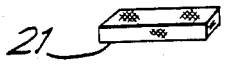
FIG. 21 is the top and side view of the combination bib and doll's eyebrows.

FIG. 5 is in the embodiment of a dog doll. The dog doll in FIG. 5 has eyes 7, a nose 15, a mouth 18, a tongue 13, a tail 8, floppy ears 30, legs 14, and arms 19.

FIGS. 1 through 5 represent a doll family inclusive of a man, a woman, a little girl, a little boy and a dog. When manufactured, FIGS. 1 through 5 can be sold separately or as a unit or family. This will be an advantage for the consumers, since the consumers will then be able to purchase the combination toddler bib and dolls according to their own economic situations.

The body of bib 22 will keep the toddler's clothing clean during feeding, while the dolls of FIGS. 1 through 5 will keep the toddler playfully occupied during such feeding. The toddler will be able to easily grasp onto or touch the dolls legs 14, arms 19 or any other previously mentioned facial feature. This will playfully occupy the child while feeding to make feeding easier and more pleasant for the parent or guardian as well as for the toddler.

The preferred embodiments of this invention have been set forth in the descriptions and drawings. These descriptions are used in a generic sense only and not for purposes of limitation. Various modifications may therefore be made therein without departing from the spirit and scope of the invention.

Having thus fully described my invention, what I claim as new and useful and desire to secure by Letters Patent is:

1. A toddler bib and doll which comprises in combination:

a protective covering means for toddler while eating, said covering portion being of reusable, washable and non-toxic towel material; and a means for smoothly fitting and securing said toddler bib around the toddler's neck, said means including two armlike extensions of towel material configured to define a neckline and said armlike extensions each having at their ends a means for removably attaching armlike extensions around toddler's neck; and a doll's facial features and accessories made with towel material of contrasting colors, sewn, by any means, onto the front body portion of the toddler bib, thereby resulting in a three dimensional doll's face on toddler bib; and a doll's arms and legs made with towel material sewn, by any means, to the edges of said toddler bib in the areas most appropriate for said arms and legs, said arms and legs being of sufficient length and density to enable a toddler to easily grasp; and a doll's hair made with trimming material, sewn, by any means, to the body portion of the toddler bib in the areas most appropriate for said hair; and a bib body portion that has, contoured around it's edges, bias tape, sewn by any means.

2. The combination toddler bib and doll of claim 1 wherein the doll is in the embodiment of a little girl.

3. The combination toddler bib and doll of claim 1 wherein the doll is in the embodiment of a little boy.

4. The combination toddler bib and doll of claim 1 wherein the doll is in the embodiment of a woman.

5. The combination toddler bib and doll of claim 1 wherein the doll is in the embodiment of a man.

6. A toddler bib and dog like animal figure which comprises in combination:

a protective covering means for toddler while eating, said covering portion being of reusable, washable and non-toxic towel material; and a means for smoothly fitting and securing said toddler bib around the toddler's neck, said means including two armlike extensions of towel material configured to define a neckline and said armlike extensions each having at their ends a means for removably attaching armlike extensions around toddler's neck; and a dog like animal figure's facial features made with towel material of contrasting colors, sewn, by any means, onto the front body portion of the toddler bib, thereby resulting in a three dimensional dog like animal figure's face on toddler bib; and a dog like animal figure's arms, legs, tail and floppy ears made with towel material, sewn, by any means, to the edges of said toddler bib in the areas most apropriate for said arms, legs, tail and floppy ears, said arms, legs, tail and floppy ears being of sufficient length and density to enable a toddler to easily grasp; and a bib body portion that has, contoured around it's edges, bias tape, sewn by any means.

7. The doll's of claims 2, 3, 4 or 5 are provided with clothing, wherein the clothing of the doll's of claims 2, 3, 4 or 5 is made with towel material of contrasting colors, sewn, by any means, to the body portion of the toddler bib covering all or part of the doll's legs.

* * * * *